US010000988B2

(12) United States Patent
Bailey et al.

(10) Patent No.: US 10,000,988 B2
(45) Date of Patent: Jun. 19, 2018

(54) SEAL ASSEMBLIES IN SUBSEA ROTATING CONTROL DEVICES

(71) Applicant: WEATHERFORD TECHNOLOGY HOLDINGS, LLC, Houston, TX (US)

(72) Inventors: Thomas F. Bailey, Houston, TX (US); Danny W. Wagoner, Cypress, TX (US); James W. Chambers, Hackett, AR (US); Andrew A. W. Barry, Missouri City, TX (US); Simon J. Harrall, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 915 days.

(21) Appl. No.: 13/645,738

(22) Filed: Oct. 5, 2012

(65) Prior Publication Data

US 2013/0192847 A1 Aug. 1, 2013

Related U.S. Application Data

(60) Provisional application No. 61/545,100, filed on Oct. 7, 2011.

(51) Int. Cl.
*E21B 33/08* (2006.01)
*E21B 33/02* (2006.01)

(52) U.S. Cl.
CPC ..... *E21B 33/085* (2013.01); *E21B 33/02* (2013.01)

(58) Field of Classification Search
CPC ..... E21B 33/085; E21B 33/02; E21B 33/08
See application file for complete search history.

(56) References Cited

U.S. PATENT DOCUMENTS

| | | | | |
|---|---|---|---|---|
| 3,387,851 | A | 6/1968 | Cugini | |
| 3,583,480 | A * | 6/1971 | Regan | E21B 33/064 166/352 |
| 4,441,551 | A * | 4/1984 | Biffle | E21B 33/085 166/84.3 |
| 6,202,753 | B1 | 3/2001 | Baugh | |
| 6,230,824 | B1 | 5/2001 | Peterman et al. | |
| 7,926,560 | B2 | 4/2011 | Bailey et al. | |
| 8,522,864 | B1 | 9/2013 | Miller | |
| 2004/0154835 | A1 | 8/2004 | Allen et al. | |
| 2005/0241833 | A1 | 11/2005 | Bailey | |

(Continued)

FOREIGN PATENT DOCUMENTS

GB 2416789 A 2/2006

OTHER PUBLICATIONS

Hustedt, Bernhard, International Search Report, dated Oct. 25, 2013, 7 pages, European Patent Office, Rijswijk, Netherlands.

(Continued)

*Primary Examiner* — Robert E Fuller
*Assistant Examiner* — David Carroll
(74) *Attorney, Agent, or Firm* — Smith IP Services, P.C.

(57) ABSTRACT

Rotating control device related oilfield pressure control is accomplished by upper and lower seal members configured to seal around a tubular, a chamber defined between the upper and lower seal members; and wherein fluid enters and/or exits the chamber via some device or structure. Such a device or structure could be a relief valve, a first accumulator, a pressure control valve, an orifice, and/or a void space in a seal member in a location which contacts the tubular.

27 Claims, 12 Drawing Sheets

(56) References Cited

U.S. PATENT DOCUMENTS

| | | | | |
|---|---|---|---|---|
| 2009/0283279 | A1 | 11/2009 | Patel | |
| 2010/0175882 | A1* | 7/2010 | Bailey | E21B 33/085 166/335 |
| 2011/0024195 | A1* | 2/2011 | Hoyer | E21B 21/00 175/65 |

OTHER PUBLICATIONS

Hustedt, Bernhard, Written Opinion of the International Searching Authority, dated Oct. 25, 2013, 10 pages, European Patent Office, Rijswijk, Netherlands.
Australian Examination Report dated Apr. 15, 2016 for AU Patent Application No. 2012318451, 8 pages.
Australian Examination Report dated Mar. 9, 2017 for AU Patent Application No. 2016210618, 3 pages.

* cited by examiner

SEAL ASSEMBLIES IN SUBSEA ROTATING CONTROL DEVICES

CROSS-REFERENCE TO RELATED APPLICATIONS

This application claims the benefit of U.S. Provisional Application No. 61/545,100 filed on Oct. 7, 2011.

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

Oilfield operations may be performed in order to extract fluids from the earth. When a well site is completed, pressure control equipment may be placed near the surface of the earth including in a subsea environment. The pressure control equipment may control the pressure in the wellbore while drilling, completing and producing the wellbore. The pressure control equipment may include blowout preventers (BOP), rotating control devices, and the like.

The rotating control device or RCD is a drill-through device with a rotating seal that contacts and seals against the drill string (drill pipe, casing, drill collars, kelly, etc.) for the purposes of controlling the pressure or fluid flow to the surface. The RCD may have multiple seal assemblies and, as part of a seal assembly, may have two or more seal elements in the form of stripper rubbers for engaging the drill string and controlling pressure up and/or downstream from the stripper rubbers. For reference to an existing description of a rotating control device incorporating a pair of opposed sealing elements, please see U.S. Pat. No. 6,230,824 entitled "Rotating Subsea Diverter", granted May 15, 2001, the disclosure of which is hereby incorporated by reference.

The seal elements in the RCD or other pressure control equipment have a tendency to wear out quickly. For example, tool joints passing through the sealing element may cause failure in the sealing element via stresses eventually causing fatigue and/or via chunks of seal material tearing out of the sealing element. In high pressure, and/or high temperature wells the need is greater for a more robust and efficient seal element.

In subsea RCDs, the RCD may have two or more seal elements which may be stripper rubbers. One seal element may be at an inlet to the RCD and exposed to a riser above the RCD. A second seal element may be located downstream of the first seal element and may be exposed to the wellbore pressure below. This second seal element may seal the wellbore pressure in the wellbore.

As the drill string is run into, and/or out of the RCD, this movement may have certain effects that could enhance the risk of failure to a sealing element. The axial movement whether upward or downward will cause the drill string to move through chambers or regions between two sealing elements. At a first interval in which a tool joint of larger volume than the drill string enters the chamber, the chamber will vacate some fluid through a sealing element in order to account for the increased volume of the tool joint. At a second interval when such tool joint passes out of the chamber there is less fluid in the chamber (and less volume of tool in the chamber) thereby causing a reduction in pressure or suction within the chamber. Optionally, at a third interval, a still larger volume tool joint may enter the chamber causing further vacation of fluid. Optionally, at a fourth interval, as the relatively larger volume tool joint emerges from the chamber a further reduction in pressure may result within the chamber. Accordingly, it is possible that suction or vacuum pressure may build up in the chamber between the first sealing element and the second sealing element. This vacuum pressure may enhance the risk of failure to the sealing element(s). There is a need for an improved RCD for controlling the pressure differential between the sealing elements in a subsea RCD.

SUMMARY

RCD related oilfield pressure control may be accomplished by upper and lower seal members configured to seal around a tubular, a chamber defined between the upper and lower seal members; and wherein fluid enters and/or exits the chamber via some device or structure. Such a device or structure could be a relief valve, a first accumulator, a pressure control valve, an orifice, and/or a void space in a seal member in a location which contacts the tubular.

DETAILED DESCRIPTION OF EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
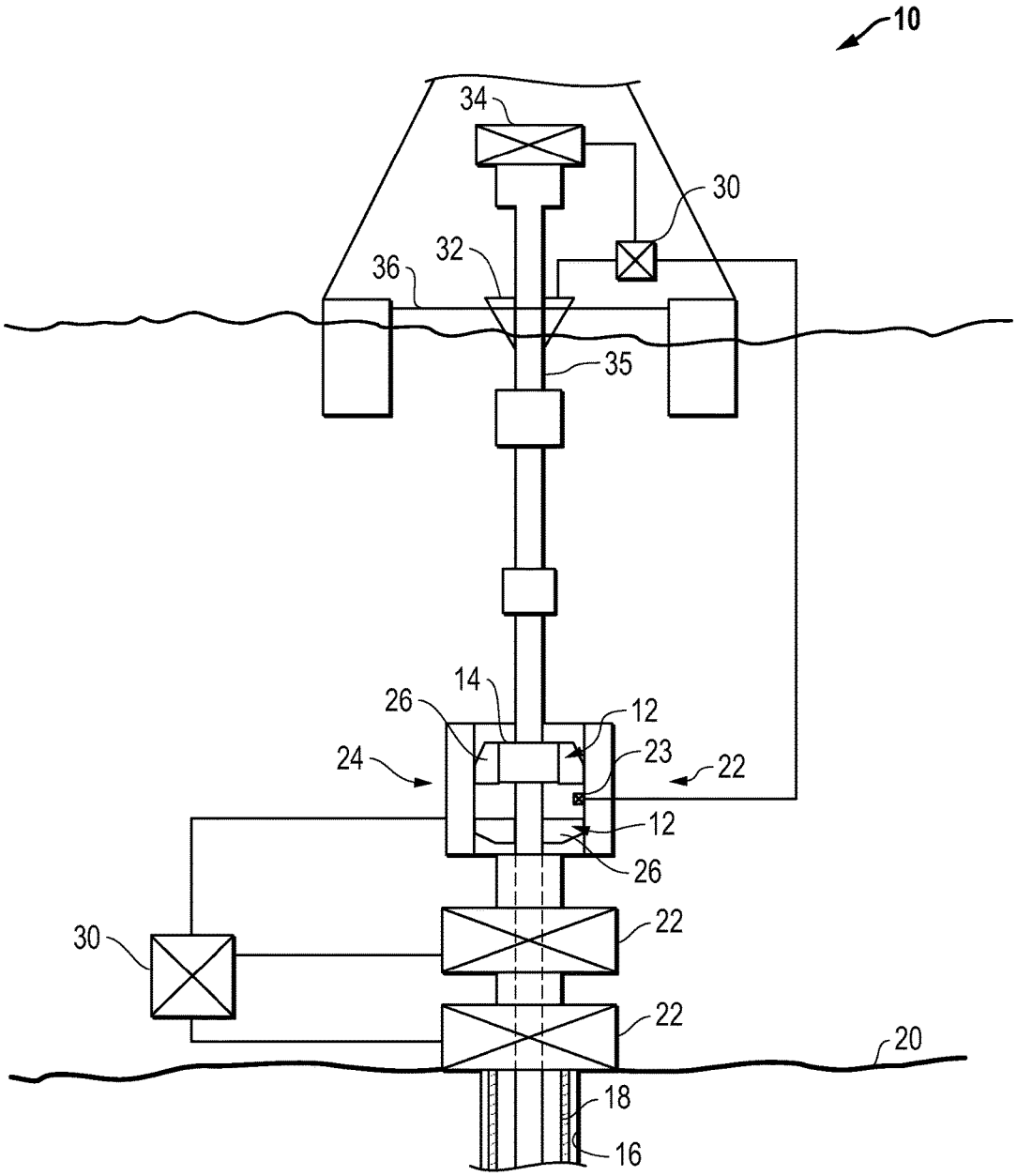
FIG. 1 depicts a schematic view of an offshore wellsite.

FIG. 1 depicts a schematic view of an offshore wellsite 10 having one or more seal elements 12 for sealing an item or piece of oilfield equipment 14. The wellsite 10 may have a wellbore 16 formed in the earth and lined with a casing 18. At a sea bed 20 one or more pressure control devices 22 may control pressure in the wellbore 16. The pressure control devices 22 may include, but are not limited to, BOPs, RCDs 24, and the like. The seal elements 12 are shown and described herein as being located in an RCD 24. The one or more seal elements 12 may be one or more annular stripper rubbers 26 located within the RCD 24. The seal elements 12 may be configured to engage and seal the oilfield equipment 14 during oilfield operations. The oilfield equipment 14 may be any suitable equipment to be sealed by the sealing element 12 including, but not limited to, a drill string, a tool joint, a bushing, a bearing, a bearing assembly, a test plug, a snubbing adaptor, a docking sleeve, a sleeve, sealing elements, a tubular, a drill pipe, a tool joint, and the like.

The wellsite 10 may have a controller(s) 30 for controlling the equipment about the wellsite 10. The controller 30, and/or additional controllers (not shown), may control and/or obtain information from any suitable system about the wellsite 10 including, but not limited to, the pressure control devices 22, the RCD 24, one or more sensor(s) 23, a gripping apparatus 32, a rotational apparatus 34, and the like. As shown, the gripping apparatus 32 may be a pair of slips configured to grip a tubular 35 (such as a drill string, a production string, a casing and the like) at a rig floor 36; however, the gripping apparatus 32 may be any suitable gripping device. As shown, the rotational apparatus 34 is a top drive for supporting and rotating the tubular 35, although it may be any suitable rotational device including, but not limited to, a kelly, a pipe spinner, and the like. The controller 30 may control any suitable equipment about the wellsite 10 including, but not limited to, a draw works, a traveling block, pumps, mud control devices, cementing tools, drilling tools, and the like.

Figure 2:
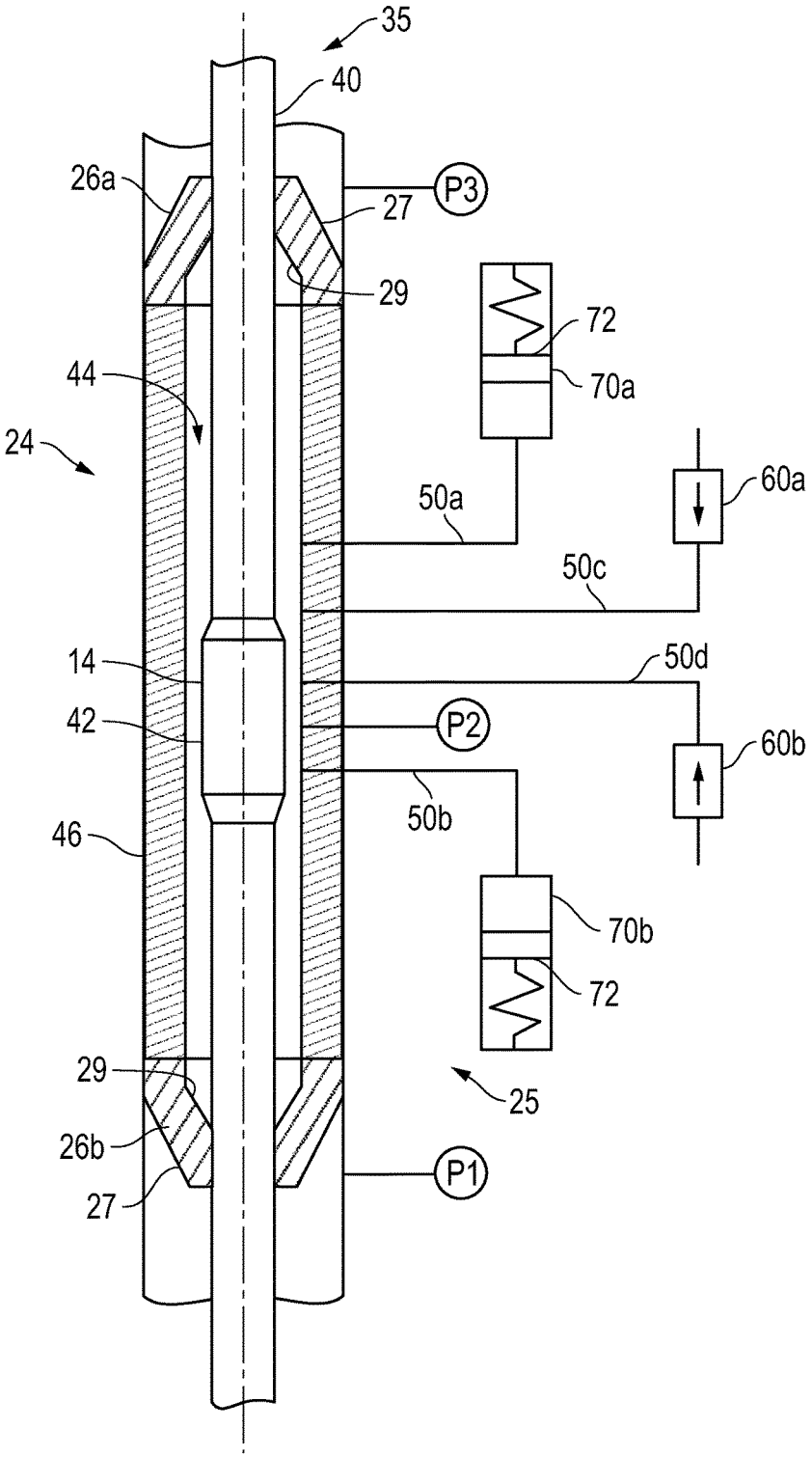
FIG. 2 depicts a cross-sectional view of an RCD according to an embodiment.

FIG. 2 depicts a cross sectional schematic view of the RCD 24 according to an embodiment. The RCD 24 as shown has a seal assembly 25 with at least two seal elements 12 in the form of stripper rubbers 26. The seal assembly may further include relief valve(s) 60 and/or accumulator(s) 70. The stripper rubbers 26 are placed in an upper-lower relationship such that there is an upper stripper rubber 26*a* and a lower stripper rubber 26*b*. The stripper rubbers 26 seal against the tubular 35 and/or piece of oilfield equipment 14/tool joint 42 (as the case may be) when the pressure is greater on the exterior side 27 of the stripper rubber 26 as compared to the pressure on the interior side 29 of the stripper rubber 26. When the pressure is greater on the interior side 29 as compared to the exterior side 27, then fluid may "burp" or seep through the stripper rubber 26 at the interface between the stripper rubber 26 and the tubular 35/tool joint 14.

Figure 3:
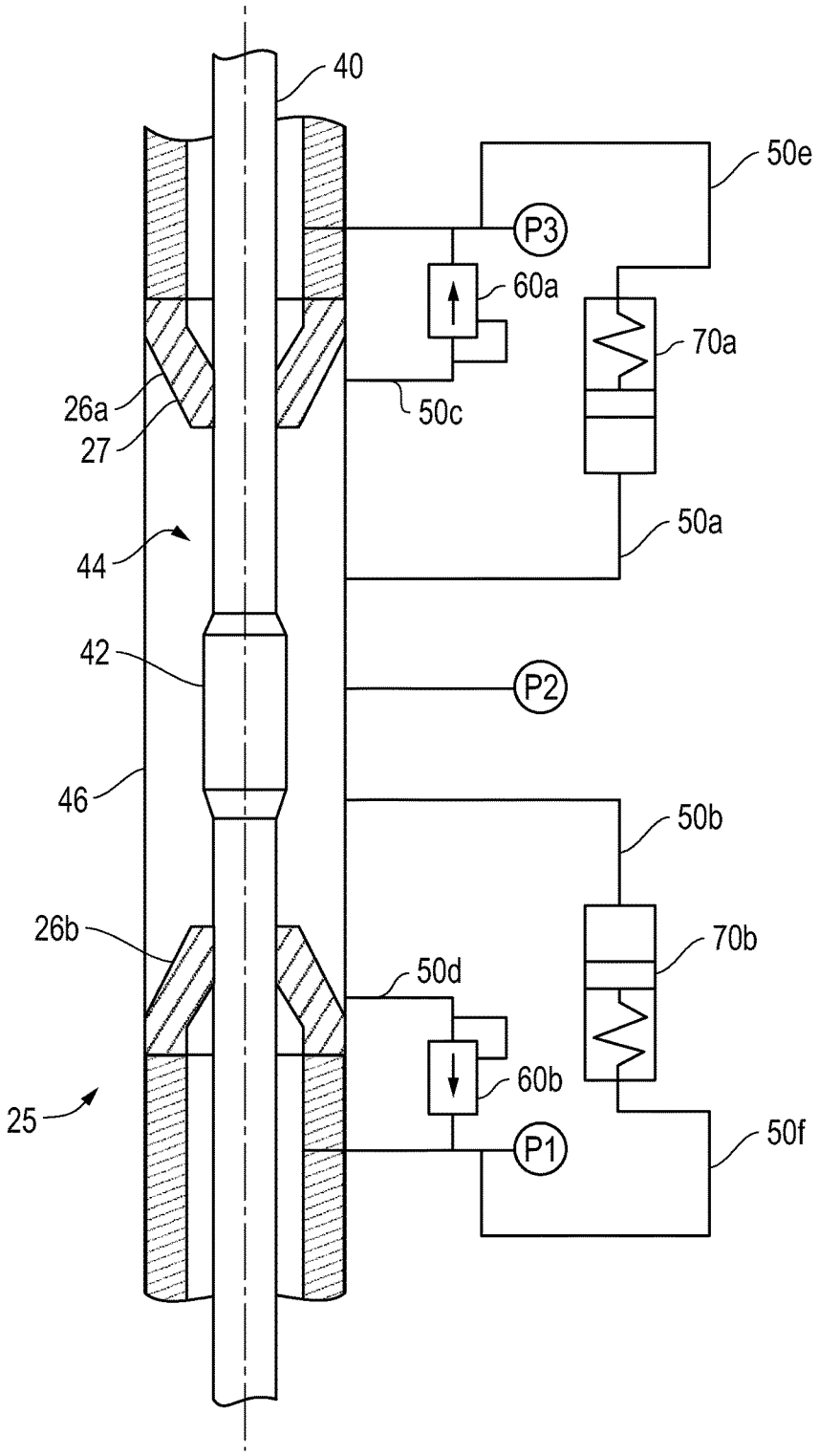
FIG. 3 depicts a cross-sectional view of an RCD according to an embodiment.

The stripper rubbers 26 may face outward (exterior side 27 outside the pressure control chamber 44) as represented in FIG. 2. In alternative embodiments, stripper rubbers 26 may face inward (exterior side 27 defining the pressure control chamber 44) as represented in FIG. 3.

In an embodiment, the piece of oilfield equipment 14 entering and/or exiting the RCD 24 is a drill string 40 having one or more tool joints 42 on the drill string 40. The tool joints 42 have a larger outer diameter than the drill pipe of the drill string 40. Further, the tool joints 42 may increase, and/or decrease, in size as the oilfield equipment 14 is run into or out of the wellbore 16 (as shown in FIG. 1). A pressure control chamber 44 is defined by and located between the upper stripper rubber 26*a* and the lower stripper rubber 26*b* and within bearing assembly 46. As a tool joint 42 enters the pressure control chamber 44, fluid within the pressure control chamber is displaced out of the pressure control chamber 44. The fluid may be displaced through the stripper rubbers 26*a* and/or 26*b*, and or along a flow path 50*a,b,c* and/or *d* (shown schematically) and the like.

As a drill string with various sized tool joints 42 passes through a stripper rubber 26 and in and out of the pressure control chamber 44, a condition of excessive pressure differential could build between the intermediate pressure control chamber 44 at pressure P2 as compared to the pressure below at pressure P1 (wellbore pressure below the bearing assembly 46) or the pressure above at pressure P3 (the pressure in a riser above the bearing assembly 46, or the sea in the case of riser-less drilling operations). The excessive pressure differential could result from tool joints 42 of greater volume displacing or bleeding a volume of fluid from the intermediate pressure control chamber 44 through a stripper rubber 26 and, successively, as the tool joint 42 vacates the intermediate pressure control chamber 44 there is now a lesser total volume of fluid within the pressure control chamber 44, causing a reduction in pressure P2 or suction (as compared to the pressure P1 or P3). Such may cause an increased friction force between the stripper rubbers 26*a* and 26*b* and the oilfield equipment 14 with downward movement of a tool joint 42 causing stripping down on the stripper rubber 26 and upward movement of a tool joint causing upward stripping on the stripper rubber 26.

In order to alleviate the wear and tear on the stripper rubbers 26*a* and 26*b* various pressure differential accommodation devices are integrated into the seal assembly 25. The various pressure accommodation devices may be individual or pluralities of relief valves 60 and/or accumulators 70. A relief valves or valves 60 only may be implemented as the pressure differential accommodation device. An accumulator or accumulators 70 only may be implemented as the pressure differential accommodation device. Various combinations of relief valve(s) 60 and accumulator(s) 70 may alternatively be implemented as the pressure differential accommodation device(s). The threshold pressure relief values (i.e. the threshold pressure at which any respective device will trip or accommodate to relieve a pressure differential) of the relief valves 60 and/or accumulators 70 may be selected according to any desirable threshold pressure relief value. Such selection is within the level of skill of one having ordinary skill in the art. Flow path(s) 50*a,b,c,d* etc. (50*e* and 50*f* shown in FIG. 3 creating respective upper and lower flow paths to back side of the accumulators) also make part of the pressure differential accommodation devices as the case may be. The accumulators may, for example, be plunger type accumulators or have a diaphragm. Various alternative embodiments of seal assemblies 25 will be discussed below by way of example.

Figure 4:
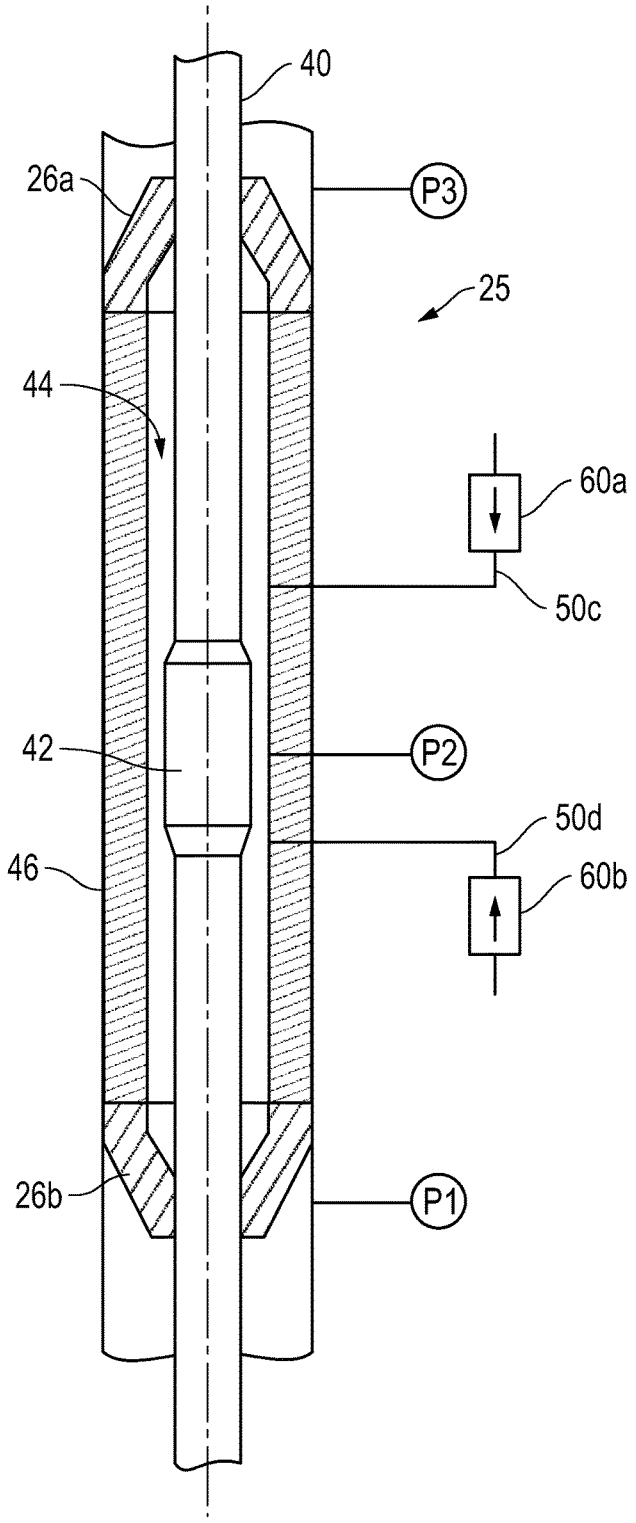
FIG. 4 depicts a cross-sectional view of an RCD according to an embodiment.

According to the embodiment of FIG. 4, the stripper rubbers 26 are facing outward. The seal assembly 25 includes relief valves 60*a* and 60*b* connected respectively via flow paths 50*c* and 50*d* as the pressure differential accommodation devices. By way of example if the differential pressure between P3 and P1 is such that P3 is higher, as tool joint 42 enters chamber 44 stripping downward or upward, pressure P2 elevates above pressure P1, and fluid bleeds by lower stripper rubber 26*b*. At the next interval as the tool joint 42 vacates chamber 44, P2 will drop. Next, top relief valve 60*a* opens at the threshold pressure which will cause P2 to vary. By way of example if the differential pressure between P3 and P1 is such that P1 is higher, as tool joint 42 enters chamber 44 stripping downward or upward, pressure P2 elevates above pressure P3, and fluid bleeds by upper stripper rubber 26*a*. At the next interval as the tool joint 42 vacates chamber 44, P2 will drop. Next, bottom relief valve 60*b* opens at the threshold pressure which will cause P2 to vary.

Figure 5:
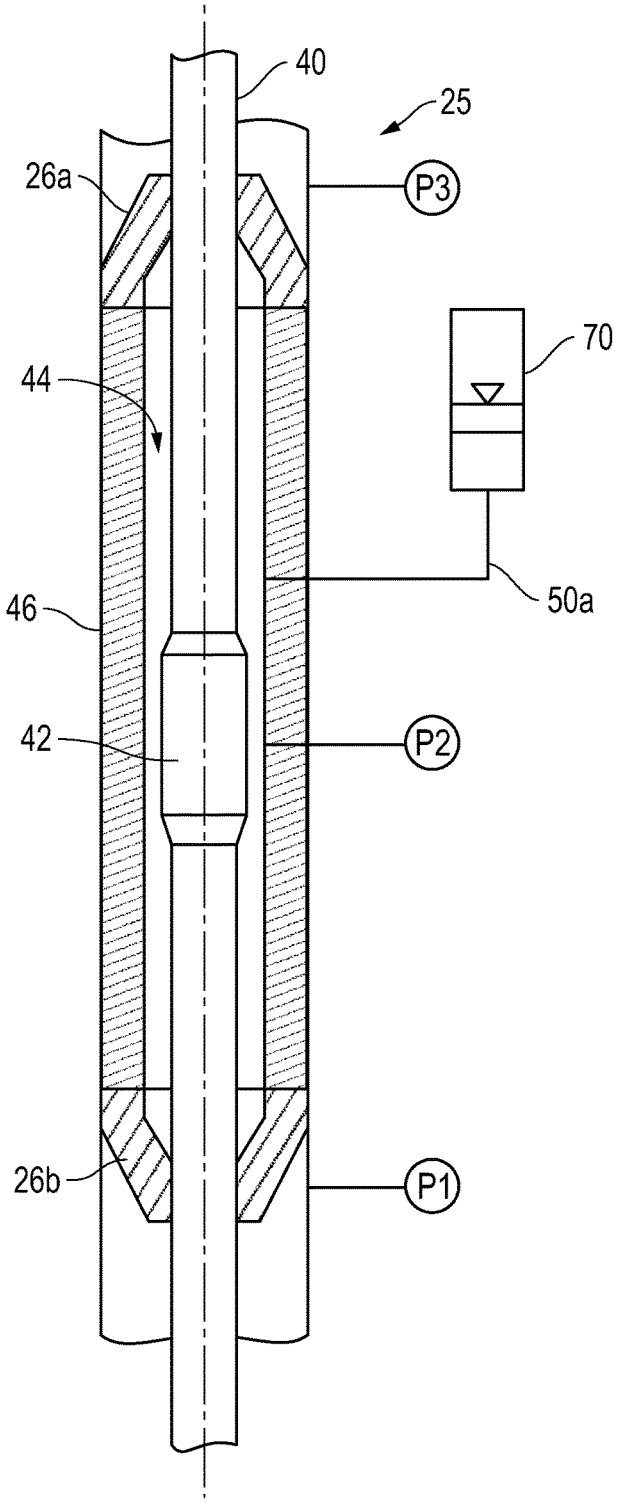
FIG. 5 depicts a cross-sectional view of an RCD according to an embodiment.

According to the embodiment of FIG. 5, the stripper rubbers 26 are facing outward. The seal assembly 25 includes one accumulator 70 connected via flow path 50*a* as the pressure differential accommodation device in combination with the stripper rubbers 26. By way of example, a first adjustment must be made for temperature. The accumulator 70 will be charged to first pressure at a first temperature. When the accumulator 70 is lowered into the sea water, the temperature will stabilize at a second temperature. A new, second pressure will be the accumulator pre-charge. When the accumulator 70 reaches the final depth in the sea, then a new volume will be established based on sea pressure. When a tool joint 42 is pulled into the chamber 44, then the fluid volume in chamber 44 will increase. The volume in accumulator 70 will decrease. The pressure in the accumulator increases (assuming the sealing element 12 or stripper rubber 26 did not leak). The stripper rubber(s) 26 (or sealing element 12) will act as a relief valve that will open at a threshold relief pressure. The stripper rubber(s) 26 can hold a back pressure up to the threshold relief pressure. If the accumulator pressure exceeds the threshold relief pressure, then the stripper rubber(s) 26 will leak.

Figure 6:
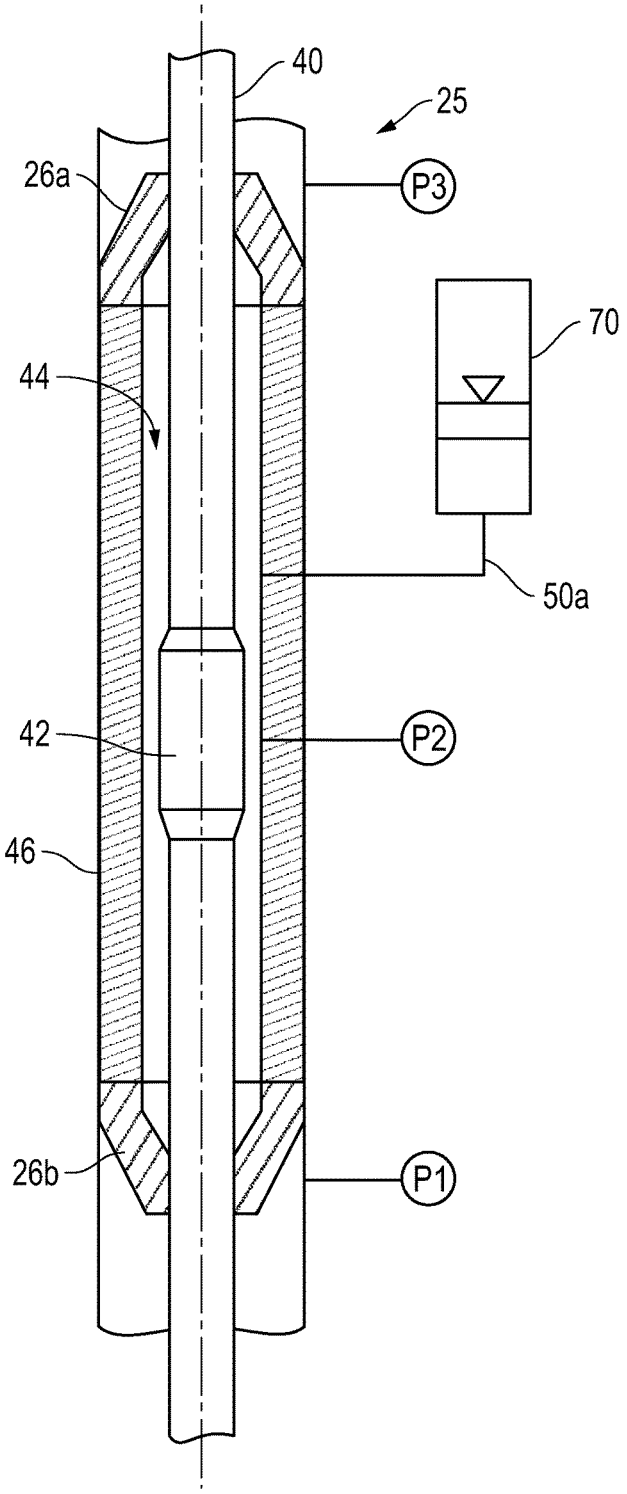
FIG. 6 depicts a cross-sectional view of an RCD according to an embodiment.

According to the embodiment of FIG. 6, the stripper rubbers 26 are facing outward. The seal assembly 25 includes one accumulator 70 (similar to the accumulator of FIG. 5 only having a larger capacity volume in this embodiment) connected via flow path 50*a* as the pressure differential accommodation device in combination with the stripper rubbers 26. By way of example, a first adjustment must be made for temperature. The accumulator 70 will be charged to first pressure at a first temperature. When the accumulator 70 is lowered into the sea water, the temperature will stabilize at a second temperature. A new, second pressure will be the accumulator pre-charge. When the accumulator 70 reaches the final depth in the sea, then a new volume will be established based on sea pressure. When a tool joint 42 is pulled into the chamber 44, then the fluid volume in chamber 44 will increase. The volume in accumulator 70 will decrease. The pressure in the accumulator increases (assuming the sealing element 12 or stripper rubber 26 did not leak). The stripper rubber(s) 26 (or sealing element 12) will act as a relief valve that will open at a threshold relief pressure. The stripper rubber(s) 26 can hold a back pressure up to the threshold relief pressure. If the accumulator pressure exceeds the threshold relief pressure, then the stripper rubber(s) 26 will leak.

Figure 7:
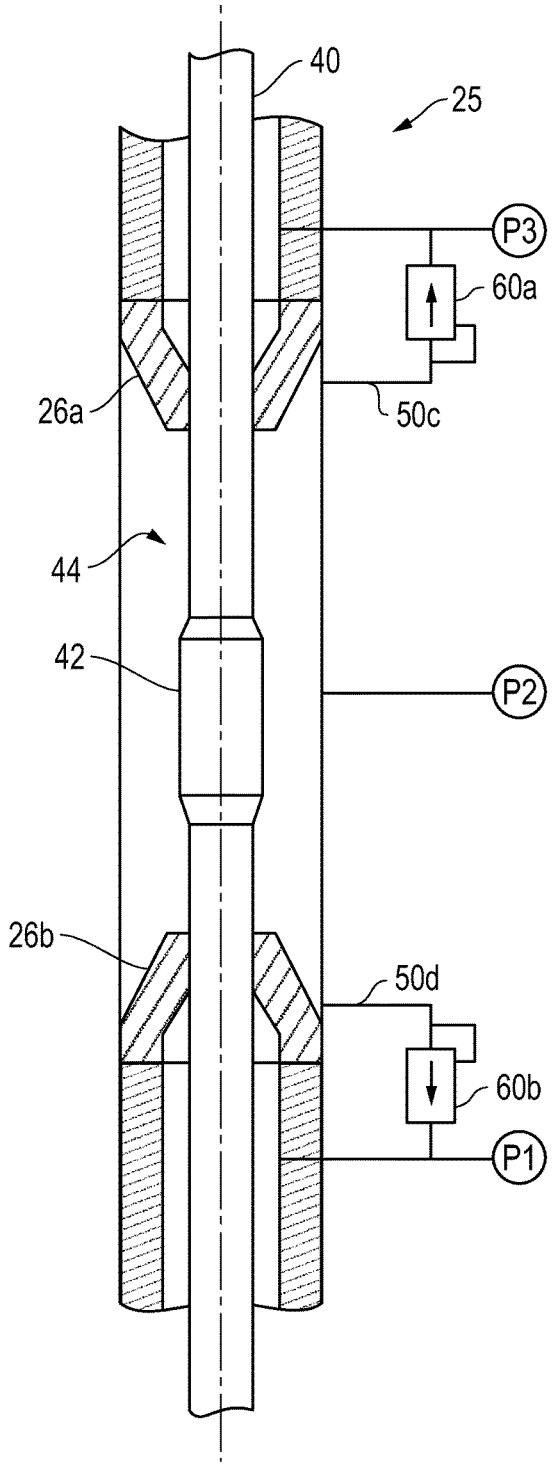
FIG. 7 depicts a cross-sectional view of an RCD according to an embodiment.

According to the embodiment of FIG. 7, the stripper rubbers 26 are facing inward. The seal assembly 25 includes relief valves 60*a* and 60*b* connected respectively via flow paths 50*c* and 50*d* as the pressure differential accommodation devices. By way of example if the differential pressure between P3 and P1 is such that P3 is higher, as tool joint 42 enters chamber 44 stripping downward or upward, pressure P2 elevates. The bottom relief valve 60*b* may limit the elevation of P2. At the next interval as the tool joint 42 vacates chamber 44, P2 will drop. Fluid may bleed by the upper stripper rubber 26*a* and bring P2 into equilibrium with P3. By way of example if the differential pressure between P3 and P1 is such that P1 is higher, as tool joint 42 enters chamber 44 stripping downward or upward, pressure P2 elevates. The top relief valve 60*a* may limit the elevation of P2. At the next interval as the tool joint 42 vacates chamber 44, P2 will drop. Fluid may bleed by the lower stripper rubber 26*b* and bring P2 into equilibrium with P1.

Figure 8:
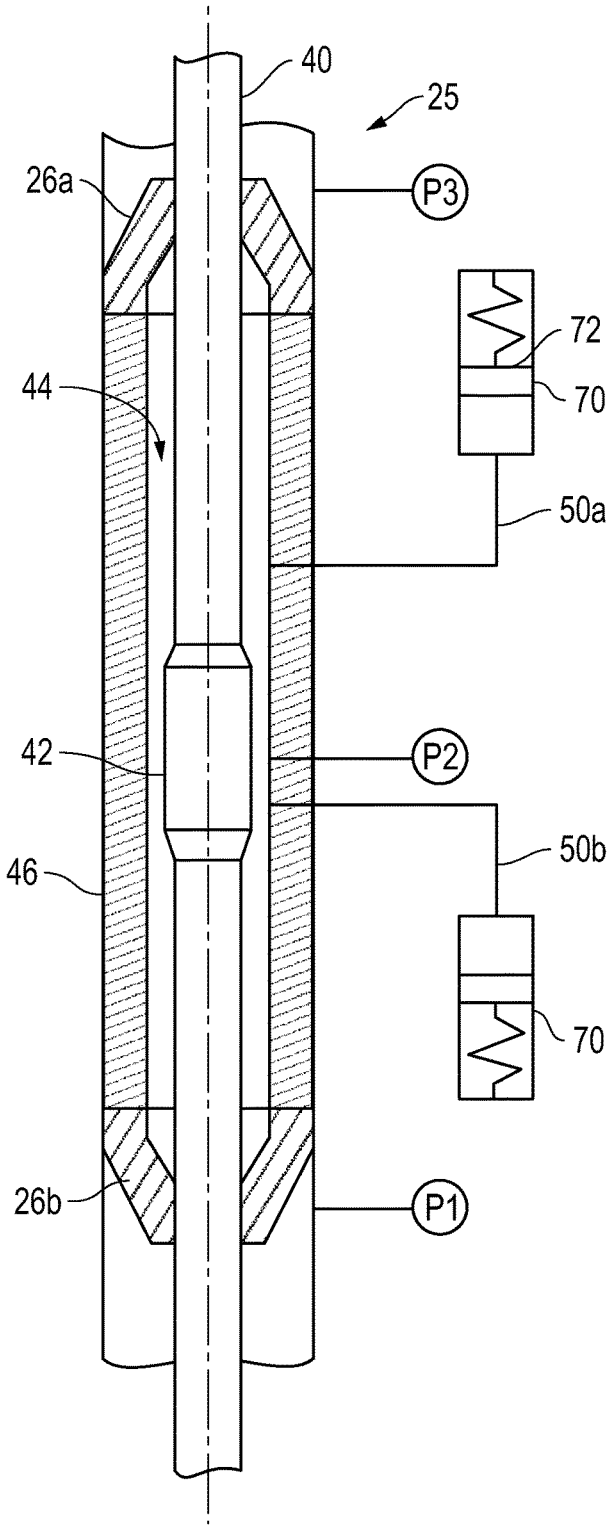
FIG. 8 depicts a cross-sectional view of an RCD according to an embodiment.

According to the embodiment of FIG. 8, the stripper rubbers 26 are facing outward. The seal assembly 25 includes accumulator(s) 70 (each having spring-type plunger 72) connected via flow paths 50*a* and/or 50*b* as the pressure differential accommodation device in combination with the stripper rubbers 26. In the case of a top accumulator only, with P3 greater than P1, after the top accumulator 70 bottoms out; tool joint(s) 42 entering chamber 44 will increase P2 to a point at which P2 exceeds P1 after-which the bottom stripper rubber 26*b* bleeds. As the tool joint 42 leaves chamber 44, P2 may remain steady. However if P1 is greater than P3, the volume of fluid displaced by the tool joint 42 may also be taken on by the accumulator as P2 increases, in which case as the tool joint 42 leaves the chamber 44 the chamber 44 may lose fluid. In the case having both a top accumulator 70 and a bottom accumulator 70, with P3 greater than P1, stripping upward or downward, the bottom accumulator 70 empty, the top accumulator 70 empty; the tool joint 42 enters the chamber 44 via stripper rubber 26; next, P2 increases; then, the bottom accumulator 70 may take volume of fluid displaced by the tool joint 42; when the tool joint 42 leaves chamber 44, the chamber 44 may lose fluid. In the case having both a top accumulator 70 and a bottom accumulator 70, with P1 greater than P3, stripping upward or downward, the bottom accumulator 70 empty, the top accumulator 70 empty; the tool joint 42 enters the chamber 44 via stripper rubber 26; next, P2 increases; then, the top accumulator 70 may take volume of fluid displaced by the tool joint 42; when the tool joint 42 leaves chamber 44, the chamber 44 may lose fluid.

Referring back to FIG. 2 the stripper rubbers 26 are facing outward. The seal assembly 25 includes accumulator(s) 70*a* and 70*b* (each having spring-type plunger 72) connected via flow paths 50*a* and/or 50*b* in combination with relief valves 60*a* and 60*b* connected respectively via flow paths 50*c* and 50*d* as the pressure differential accommodation device in combination with the stripper rubbers 26. By way of example if the differential pressure between P3 and P1 is such that P3 is higher, stripping upward or downward; the bottom accumulator 70*b* may be empty; the top accumulator 70*a* may be empty; as the tool joint 42 enters the chamber 44 via the stripper rubber 26; next, P2 increases; the bottom accumulator may take on the volume of fluid displaced by the tool joint 42; then, the tool joint 42 leaves chamber 44. The chamber 44 may lose fluid. If P2 is sufficiently lowered to beyond a threshold pressure in the relief valve, the top relief valve 60*a* may open. By way of example if the differential pressure between P3 and P1 is such that P1 is higher, stripping upward or downward; the bottom accumulator 70*b* may be empty; the top accumulator 70*a* may be empty; as the tool joint 42 enters the chamber 44 via the stripper rubber 26; next, P2 increases; the top accumulator 70*a* may take on the volume of fluid displaced by the tool joint 42; then, the tool joint 42 leaves chamber 44. The chamber 44 may lose fluid. If P2 is sufficiently lowered to beyond a threshold pressure in the relief valve, the bottom relief valve 60*b* may open.

Referring back to FIG. 3 the stripper rubbers 26 are facing inward. The seal assembly 25 includes accumulator(s) 70*a* and 70*b* connected via flow paths 50*a* and/or 50*b* (and optionally supplied by respective flow paths 50*e* and 50*f*) in combination with relief valves 60*a* and 60*b* connected respectively via flow paths 50*c* and 50*d* as the pressure differential accommodation device in combination with the stripper rubbers 26. By way of example if the differential pressure between P3 and P1 is such that P3 is higher, stripping upward or downward; with the top accumulator

70*a* empty; the bottom accumulator 70*b* full; as the tool joint 42 enters the chamber 44 via a stripper rubber 42; next, the top accumulator 70*a* may take on the volume of fluid displaced by the tool joint 42; if chamber 44 fluid is of sufficiently low pressure, the stripper rubber 26 bleeds/burps. If the chamber 44, P2, develops overpressure beyond a threshold pressure, the bottom relief valve 60*b* may open. By way of example if the differential pressure between P3 and P1 is such that P1 is higher, stripping upward or downward; with the top accumulator 70*a* full; the bottom accumulator 70*b* empty; as the tool joint 42 enters the chamber 44 via a stripper rubber 26; next, the bottom accumulator 70*b* may take on the volume of fluid displaced by the tool joint 42; if chamber 44 fluid is of sufficiently low pressure, the stripper rubber 26 bleeds/burps. If the chamber 44, P2, develops overpressure beyond a threshold pressure, the top relief valve 60*a* may open.

Figure 9:
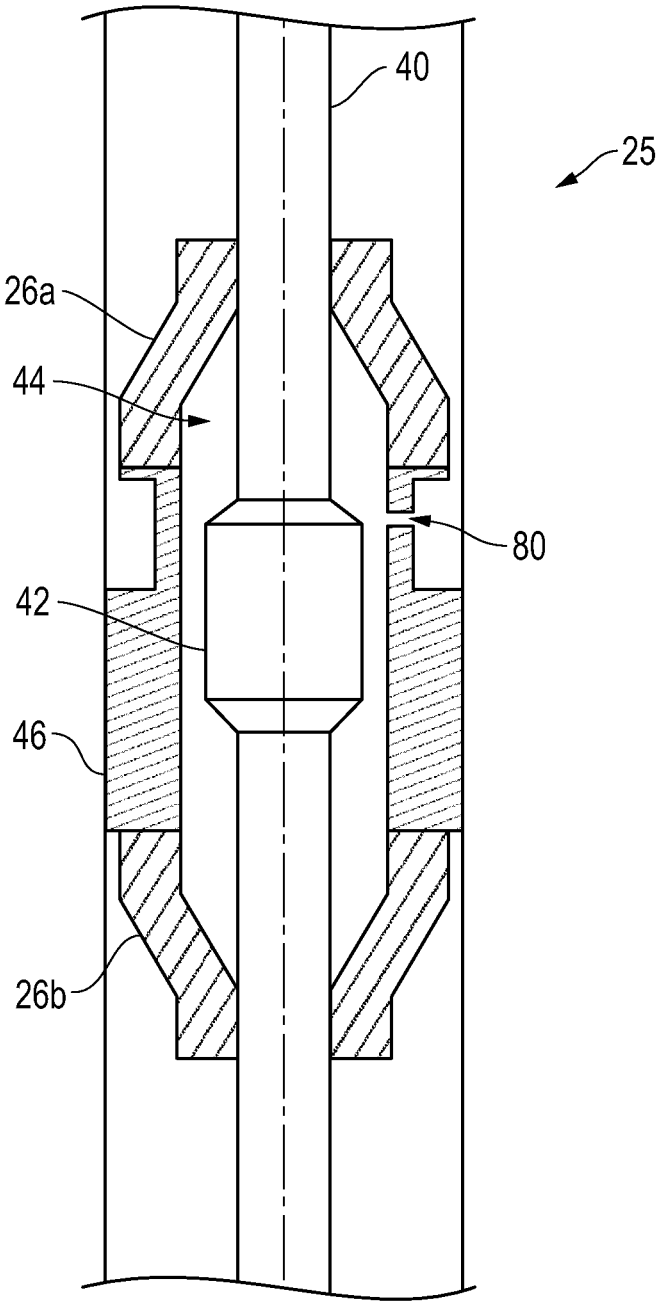
FIG. 9 depicts a cross-sectional view of an RCD according to an embodiment.
Figure 10:
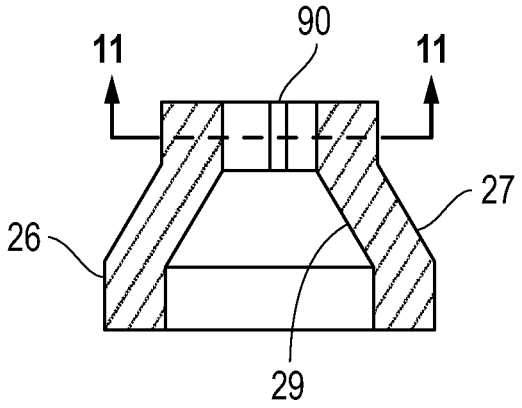
FIG. 10 depicts a cross-sectional view of an alternative embodiment of a stripper rubber.
Figure 11:
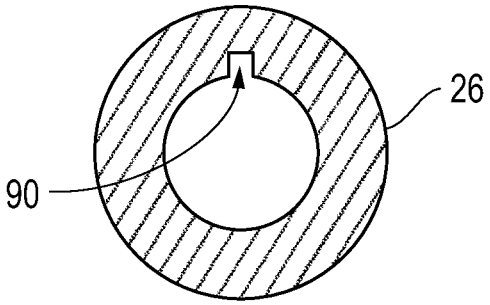
FIG. 11 depicts a sectional view taken along line 11-11 of FIG. 10.

When the riser pressure is at a pressure higher than wellbore pressure, it may be advantageous to create a constant leak path to account for greater volumes per second of pressure differential accommodation. Such a pressure differential accommodation device in one embodiment (see FIG. 9) may appear as one or more small orifices 80 near the interface of the bearing assembly 46 and the upper stripper rubber 26*a* creating a replenishment chamber/path to the chamber 44. In another embodiment (see FIGS. 10-11) it may appear as a notch or groove 90 formed or made through a portion of the upper stripper rubber 26*a*. It is to be understood that the embodiments of FIGS. 9-11 have been described as being applicable to the upper stripper rubber 26*a*, however they may be equally applicable to the lower stripper rubber 26*b*. The embodiments of FIGS. 9-11 may be combined with other pressure differential accommodation device(s).

As implied above the pressure differential accommodation device may need to function according to certain critical timing intervals depending upon displacement volumes, speed of tool joint 42 entering and vacating the chamber 44, etc. Accordingly one of ordinary skill in the art may design a respective seal assembly 25 to accommodate the rate of volume displacement.

It is to be understood that the bearing assembly 46 has been discussed above as appearing intermediate the upper stripper rubber 26*a* and the lower stripper rubber 26*b*. However, it is to be understood that in other embodiments, somewhat as represented in various figures of the drawings, the bearing assembly(ies) 46 may not appear intermediate and may appear above and/or below the respective upper stripper rubber 26*a* and the lower stripper rubber 26*b*.

The RCD 24 may have any number of elements which seal against a tubular 35 inserted through its interior. These seal elements 12 may include one or more passive seals or stripper rubbers 26. These seal elements 12 may include one or more active seals. These seal elements 12 may include only passive seals (stripper rubbers) or only active seals. In embodiments including more than one passive seal (stripper rubber), the stripper rubbers 26 may be arranged such that multiple stripper rubbers are stacked to provide contingency pressure sealing from below and/or from above. For example, two stripper rubbers 26 may be arranged to provide pressure sealing from below, and a third stripper rubber 26 arranged to provide pressure sealing from above. Any other combination and arrangement of such seals are contemplated.

Additionally, the use of multiple stacked stripper rubbers 26 may be combined with a system which controls the pressure between any two adjacent stripper rubbers 26. Such systems are shown and described in US patent publication no. 2011/0024195, which is incorporated herein by reference in its entirety for all purposes. Such systems may be used in order to control the pressure between opposed stripper rubbers 26 which face outward (exterior side 27 outside the pressure control chamber 44) as represented in FIG. 2. In alternative embodiments, such pressure management systems as shown and described in US patent publication no. 2011/0024195 may be used in order to control the pressure between opposed stripper rubbers 26 which face inward (exterior side 27 defining the pressure control chamber 44) as represented in FIG. 3.

For all embodiments, the optional inclusion of sensor 23 (see FIG. 1) to monitor the pressure within chamber 44 enables precise control of this pressure to be accomplished. Additional sensors may be positioned such that the pressure immediately above the upper stripper rubber 26*a* and/or pressure immediately below lower stripper rubber 26*b* may be monitored. One or more pressure control valves may be used in order to bleed pressure into and/or out of chamber 44; these pressure control valves may be actuated using controller 30. The use of such pressure control valves enables (in some circumstances) the path of pressure bleeding to be selected. For example, should the pressure above the upper stripper rubber 26*a* and pressure below the lower stripper rubber 26*b* be at generally similar values, then any change in the pressure within chamber 44 may be compensated by a user-selected routing of pressure bleed between chamber 44 and either the zone above upper stripper rubber 26*a* or the zone below lower stripper rubber 26*b*. This would be advantageous in ensuring that fluids in the wellbore (i.e. below lower stripper rubber 26*b*) are not inadvertently routed via chamber 44 to the zone above upper stripper rubber 26*a*.

In any of the accumulator 70 and control valve embodiments, one or more relief valves 60 may also be incorporated in order to ensure that critical overpressure or underpressure conditions do not occur.

For situations in which a riser is used while drilling the well, the pressure above upper stripper rubber 26*a* may be controlled. This may be achieved by the riser containing a suitable fluid of appropriate density and/or the application of pressure at surface to the fluid within the riser. The pressure above upper stripper rubber 26*a* may therefore be controlled such that this pressure is approximately equal to or somewhat greater than the pressure below the lower stripper rubber. In this instance, an embodiment of the configurations described herein may include only one relief valve 60 and/or only one control valve and/or only one accumulator 70. The single relief valve/control valve/accumulator may be connected between the zone below lower stripper rubber 26*b* and chamber 44. This would, advantageously, minimize the risk of wellbore fluids being communicated via chamber 44 to the riser.

The embodiments described may also be used in non-rotating pressure control devices.

Figure 12:
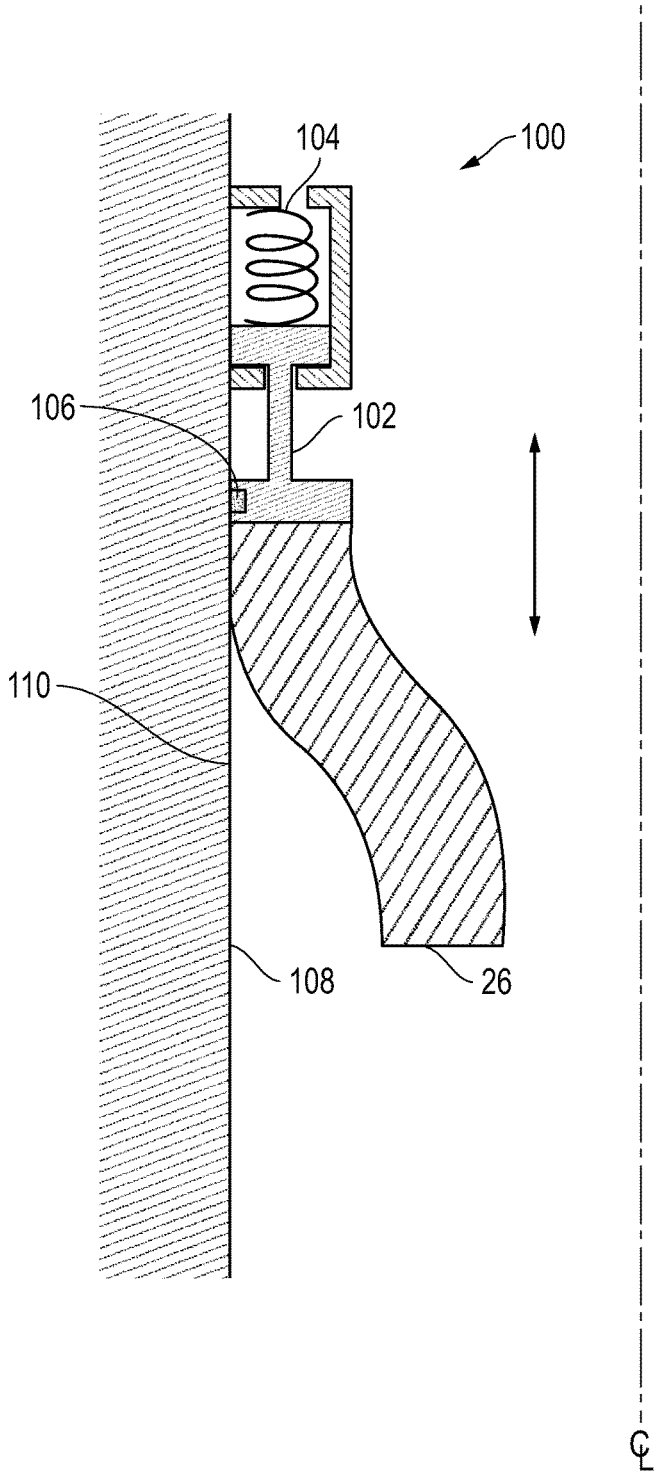
FIG. 12 depicts a cross-sectional view of an RCD according to an embodiment.

An embodiment of a stripper rubber assembly is shown in FIG. 12. Stripper rubber assembly 100 may be configured such that, in use, a change in pressure within chamber 44 may urge stripper rubber 26 to move axially. In this way, the volume of chamber 44 may be maintained substantially constant despite the passage of tool joint 42 (not shown). Stripper rubber 26 is mounted via a mounting assembly 102 so as to be positionally biased in a downward direction by biasing member 104. In one embodiment, biasing member 104 may be a spring. Alternatively, or in addition, the biasing of stripper rubber 26 may be achieved through a pressurized fluid acting upon mounting assembly 102. Because stripper rubber 26 may move axially, a seal 106 may be utilized between mounting assembly 102 and the interior surface 108 of external member 110. External member 110 may be part of housing or bearing assembly, or any other member suitable for sealing against.

Stripper rubber assembly 100 is shown with stripper rubber 26 facing downward and biased downward. However, it is also contemplated that stripper rubber assembly 100 may be mounted inverted with stripper rubber 26 facing upward and biased upward.

Figure 13:
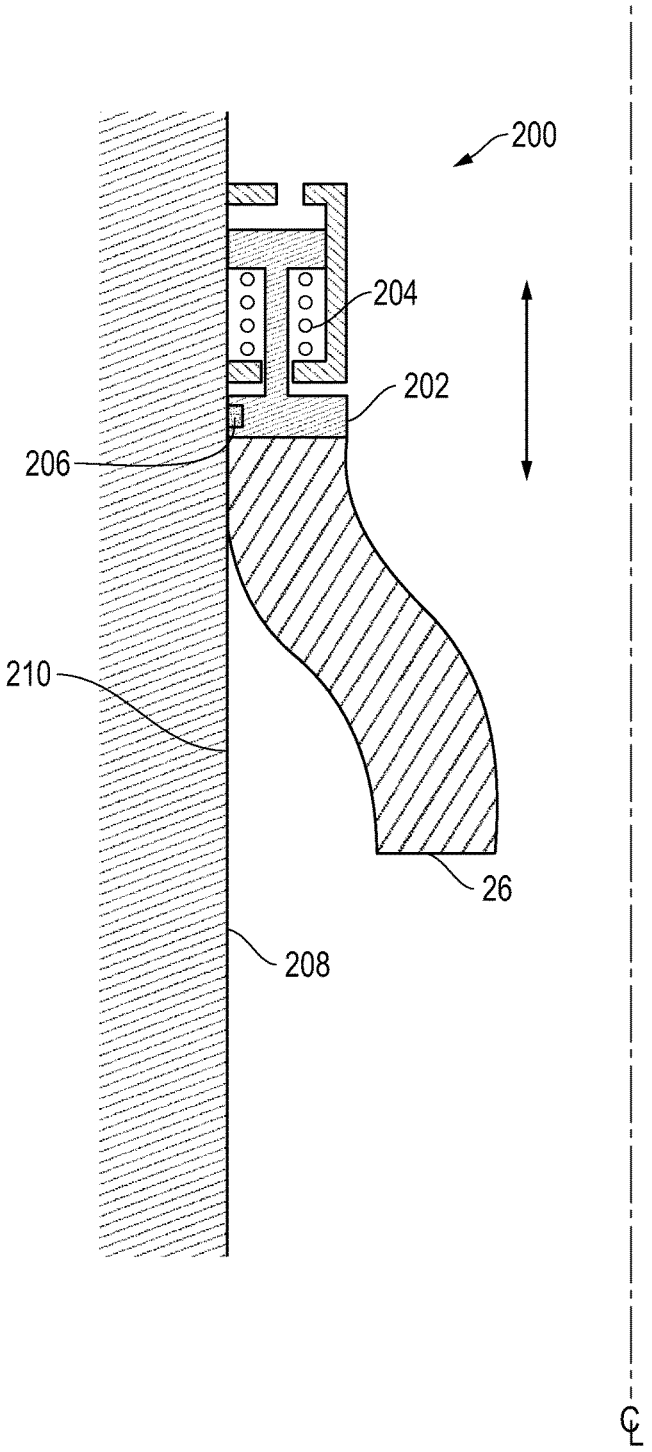
FIG. 13 depicts a cross-sectional view of an RCD according to an embodiment.

An alternative embodiment of a stripper rubber assembly is shown in FIG. 13. Stripper rubber assembly 200 may also be configured such that, in use, a change in pressure within chamber 44 may urge stripper rubber 26 to move axially. In this way, the volume of chamber 44 may be maintained substantially constant despite the passage of tool joint 42 (not shown). Stripper rubber 26 is mounted via a mounting assembly 202 so as to be positionally biased in an upward direction by biasing member 204. In one embodiment, biasing member 204 may be a spring. Alternatively, or in addition, the biasing of stripper rubber 26 may be achieved through a pressurized fluid acting upon mounting assembly 202. Because stripper rubber 26 may move axially, a seal 206 may be utilized between mounting assembly 202 and the interior surface 208 of external member 210. External member 210 may be part of a housing or bearing assembly, or any other member suitable for sealing against.

Stripper rubber assembly 200 is shown with stripper rubber 26 facing downward and biased upward. However, it is also contemplated that stripper rubber assembly 100 may be mounted inverted with stripper rubber 26 facing upward and biased downward.

In one embodiment, one or more of the stripper rubbers 26*a* and 26*b* shown in FIG. 2 may be configured using stripper rubber assembly 100 and/or stripper rubber assembly 200, such that either or both stripper rubbers 26*a* and 26*b* are biased axially away from each other. In this configuration, relief valves 60*a* and 60*b* and/or accumulators 70*a* and 70*b* may be omitted, such that chamber 44 is without any ports. In operation, when tool joint 42 enters chamber 44, the fluid within chamber 44 is trapped, and therefore the pressure within chamber 44 rises. This pressure acts on both stripper rubbers 26*a* and 26*b* and therefore may lead to "burping" or leakage of the pressure past the tubular 35 or drill string 40, as described above. Then, when tool joint 42 exits chamber 44, the available volume for the fluid within chamber 44 increases, thereby creating a momentary decrease in pressure within chamber 44. Existing pressure above stripper rubber 26*a* and below stripper rubber 26*b* now acts against biasing members 104/204. The magnitude of the biasing force provided by biasing members 104/204 may be selected such that when the pressure within chamber 44 reaches a selected value, one or both stripper rubbers 26*a* and 26*b* will move axially such that the stripper rubbers 26*a* and 26*b* momentarily become closer together. This results in a momentary decrease in the size of chamber 44, which alleviates the drop in pressure within chamber 44. With the entry of a second tool joint 42 into the chamber 44, the available volume for the fluid trapped within chamber 44 again decreases, thereby resulting in a momentary rise in pressure within chamber 44. This rise in pressure may be accommodated by either the "burping" phenomenon described above, and/or axial movement of one or both stripper rubbers 26*a*, 26*b*, such that stripper rubbers 26*a*, 26*b* become axially further apart, which is promoted by biasing members 104/204. Again, the exit of the second tool joint 42 may be accompanied by axial movement of one or both stripper rubbers 26*a*, 26*b* such that they become axially closer together. In this way, pressure fluctuations within chamber 44 may be accommodated without the need to vent fluid either out of or into chamber 44.

In one embodiment, one or more of the stripper rubbers 26*a* and 26*b* shown in FIG. 3 may be configured using stripper rubber assembly 100 and/or stripper rubber assembly 200, such that either or both stripper rubbers 26*a* and 26*b* are biased axially towards each other. In this configuration, relief valves 60*a* and 60*b* and/or accumulators 70*a* and 70*b* may be omitted, such that chamber 44 is without any ports. In operation, when tool joint 42 enters chamber 44, the fluid within chamber 44 is trapped, and therefore the pressure within chamber 44 rises. This pressure acts on both stripper rubbers 26*a* and 26*b* and therefore also acts against biasing members 104/204. The magnitude of the biasing force provided by biasing members 104/204 may be selected such that when the pressure within chamber 44 reaches a selected value, one or both stripper rubbers 26*a* and 26*b* will move axially such that the stripper rubbers 26*a* and 26*b* momentarily become further apart. This results in a momentary increase in the size of chamber 44, which alleviates the rise in pressure within chamber 44. Then, when tool joint 42 exits chamber 44, the available volume for the fluid within chamber 44 increases, thereby creating a momentary decrease in pressure within chamber 44. At this stage, the force exerted on stripper rubbers 26*a* and 26*b* which has caused their axial separation now decreases, and biasing members 104/204 may act on one or both stripper rubbers 26*a* and 26*b* to move them back closer together. In this way, pressure fluctuations within chamber 44 may be accommodated without the need to vent fluid either out of or into chamber 44.

It will be appreciated that in either embodiment described above, one or more of the pressure relief mechanisms described herein may be utilized in combination with one or more stripper rubber assemblies 100/200 as described above.

While the embodiments are described with reference to various implementations and exploitations, it will be understood that these embodiments are illustrative and that the scope of the inventive subject matter is not limited to them. Many variations, modifications, additions and improvements are possible. For example, the implementations and techniques used herein may be applied to any strippers, seals, or packer members at the wellsite, such as the BOP, and the like.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An oilfield pressure control apparatus, comprising:

an upper seal member configured to seal around a tubular, wherein the upper seal member comprises a stripper rubber facing in a first axial direction;

a lower seal member configured to seal around the tubular, wherein the lower seal member comprises a stripper rubber facing in a second axial direction opposite the first axial direction;

a chamber defined by and located between the upper and lower seal members; and at least one pressure differential accommodation device in fluid communication with the chamber, wherein the at least one pressure differential accommodation device compensates for a first change in a pressure within the chamber caused by entrance of a tool joint into the chamber via one of the upper and lower seal members, and compensates for a second change in the pressure within the chamber caused by exit of the tool joint from the chamber via the other of the upper and lower seal members.

2. The oilfield pressure control apparatus of claim 1, wherein the pressure differential accommodation device comprises a relief valve in fluid communication with a region above the upper seal member.

3. The oilfield pressure control apparatus of claim 2, wherein fluid is routed through the relief valve between the region and the chamber in order to compensate for the first and second changes in the pressure within the chamber.

4. The oilfield pressure control apparatus of claim 3, wherein the fluid flows into the chamber.

5. The oilfield pressure control apparatus of claim 3, wherein the fluid flows out of the chamber.

6. The oilfield pressure control apparatus of claim 1, wherein the pressure differential accommodation device comprises a relief valve in fluid communication with a region below the lower seal member.

7. The oilfield pressure control apparatus of claim 6, wherein fluid is routed through the relief valve between the region and the chamber in order to compensate for first and second changes in the pressure within the chamber.

8. The oilfield pressure control apparatus of claim 7, wherein the fluid flows into the chamber.

9. The oilfield pressure control apparatus of claim 7, wherein the fluid flows out of the chamber.

10. The oilfield pressure control apparatus of claim 1, wherein the pressure differential accommodation device comprises a relief valve.

11. The oilfield pressure control apparatus of claim 1, wherein the pressure differential accommodation device comprises an accumulator.

12. An oilfield pressure control apparatus, comprising:

an upper seal member configured to seal around a tubular, wherein the upper seal member comprises a stripper rubber facing in a first axial direction;

a lower seal member configured to seal around the tubular, wherein the lower seal member comprises a stripper rubber facing in a second axial direction opposite the first axial direction;

a chamber defined by and located between the upper and lower seal members; and a first accumulator in fluid communication with the chamber.

13. The oilfield pressure control apparatus of claim 12, wherein the first accumulator has a first compartment in fluid communication with the chamber;

a second compartment in fluid communication with a region above the upper seal member; and a first movable barrier between the first and second compartments.

14. The oilfield pressure control apparatus of claim 13, wherein the first movable barrier is biased to tend to decrease the size of the first compartment.

15. The oilfield pressure control apparatus of claim 13, further comprising a second accumulator having a third compartment in fluid communication with the chamber;

a fourth compartment in fluid communication with a region below the lower seal member; and a second movable barrier between the third and fourth compartments.

16. The oilfield pressure control apparatus of claim 15, wherein the second movable barrier is biased to tend to decrease the size of the third compartment.

17. The oilfield pressure control apparatus of claim 12, wherein the first accumulator has a first compartment in fluid communication with the chamber;

a second compartment in fluid communication with an external pressure source; and a first movable barrier between the first and second compartments.

18. The oilfield pressure control apparatus of claim 17, wherein the external pressure source is a pressurized environment.

19. The oilfield pressure control apparatus of claim 18, wherein the oilfield pressure control apparatus is located subsea; and the pressurized environment comprises sea water pressure.

20. The oilfield pressure control apparatus of claim 18, wherein the external pressure source comprises pressurized gas.

21. The oilfield pressure control apparatus of claim 20, wherein the pressurized gas is nitrogen.

22. The oilfield pressure control apparatus of claim 12, wherein the first accumulator has a first compartment in fluid communication with the chamber;

a second compartment in fluid communication with a region below the lower seal member; and a first movable barrier between the first and second compartments.

23. The oilfield pressure control apparatus of claim 22, wherein the first movable barrier is biased to tend to decrease the size of the first compartment.

24. The oilfield pressure control apparatus of claim 1, wherein the pressure differential accommodation device comprises a pressure control valve.

25. The oilfield pressure control apparatus of claim 24, further comprising a sensor which senses pressure within the chamber.

26. The oilfield pressure control apparatus of claim 25, further comprising a controller in communication with the pressure control valve and the sensor.

27. The oilfield pressure control apparatus of claim 1, wherein the pressure differential accommodation device comprises an orifice.

* * * * *